United States Patent [19]

Marin

[11] 4,108,490

[45] Aug. 22, 1978

[54] FOLDABLE CHAIR

[76] Inventor: Jose Antonio T. Marin, Hidalgo #214, Santa Ursula, Coapa Mexico City, Mexico

[21] Appl. No.: 812,820

[22] Filed: Jul. 5, 1977

[51] Int. Cl.[2] ..... A47C 4/08

[52] U.S. Cl. ..... 297/42; 297/331

[58] Field of Search ..... 297/42, 43, 44, 16, 297/331, 315, 155, 165, 167, 6

[56] References Cited

U.S. PATENT DOCUMENTS

| | | | |
|---|---|---|---|
| 484,240 | 10/1892 | Rieckert | 297/44 |
| 1,136,308 | 4/1915 | Brewer | 297/315 |
| 1,368,802 | 2/1921 | Johnson | 297/155 X |
| 2,374,182 | 4/1945 | Duke | 297/6 |
| 2,468,683 | 4/1949 | Michal | 297/155 X |

FOREIGN PATENT DOCUMENTS

| | | | |
|---|---|---|---|
| 1,114,996 | 11/1957 | Fed. Rep. of Germany | 297/44 |
| 26,757 | 5/1932 | Netherlands | 297/42 |

*Primary Examiner*—Francis K. Zugel
*Attorney, Agent, or Firm*—Albert L. Jeffers

[57] ABSTRACT

A foldable chair having a seat member and four legs at the corners of the seat member with the two front legs extending from the seat member downwardly and with the two rear legs extending both upwardly and downwardly from the seat member. Upper and lower sets of cross members are provided each connecting a rear leg with the diagonally opposite front leg and with the cross members pivotally interconnected at the intersections thereof. A collapsible back is connected between the upper ends of the rear legs and the seat member is pivotally connected near one corner to the adjacent leg. The seat can be collapsed by tilting the seat member upwardly about the pivotal connection thereof with a leg and pivoting the intersecting cross members relatively and which will cause the chair to collapse laterally and which will also collapse the back of the chair.

7 Claims, 7 Drawing Figures

FOLDABLE CHAIR

The present invention relates to foldable chairs and, in particular, to foldable chairs which are strong but easy to collapse.

Foldable chairs are, of course, known, but a great many thereof are structurally defective because pivot joints which are provided to permit the chair to be folded up are highly stressed when the chair is in use and can become loose or deformed or can fail. In other cases, a substantial compromise with engineering principles are effected in order to make a chair which can be folded.

A particular object of the present invention is to provide a foldable chair which is extremely strong but which can readily be collapsed or folded into small space.

Another object is the provision of a foldable chair which, when erected, presents a substantially conventional appearance.

A still further object is the provision of a foldable chair having pivotal connections between the relatively movable parts of the chair, but wherein the pivotal connections are not highly stressed when the chair is in use.

BRIEF SUMMARY OF THE INVENTION

According to the present invention, a chair is provided having a generally rectangular seat member with two downwardly extending forward legs at the front corners of the seat member and a pair of vertically extending rear legs at the rearward corners of the seat member with the rearward legs extending both downwardly and upwardly from the plane of the seat member. The upper ends of the rear legs are interconnected by a collapsible back support.

Each rear leg is connected with the diagonally opposite forward leg by upper and lower cross members which are fixed to the respective legs. Each pair of cross members is interconnected by a pivot bolt in about the geometric center of the region defined by the four legs of the chair.

The seat member is pivotally connected to one of the legs so that it can be tilted and swivelled about the connection.

The upper cross member of the upper pair of cross members is disposed directly beneath the seat member and provides support for the seat member when the chair is in unfolded and erected position.

The exact nature of the present invention will become more clearly apparent upon reference to the following detailed specification taken in connection with the accompanying drawings in which:

DETAILED DESCRIPTION OF THE INVENTION

Figure 2:
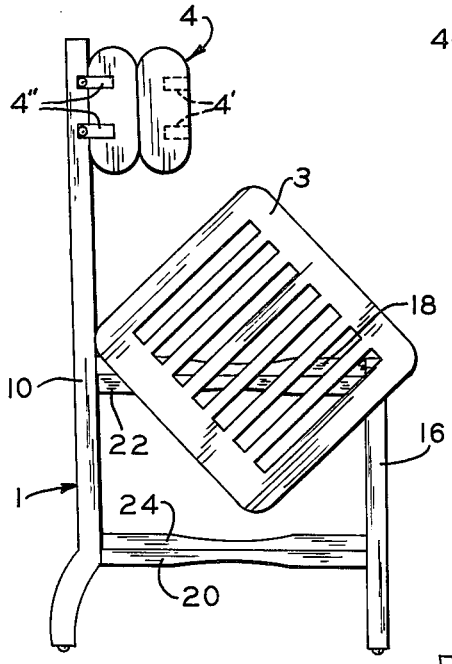
FIG. 2 is a view of the chair according to the present invention in collapsed condition.
Figure 2A:
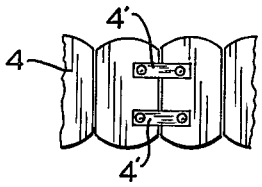
FIG. 2A is a fragmentary view showing the collapsible back which is connected between the rear legs of the chair.

Referring to the drawings somewhat more in detail, a chair according to the present invention comprises two basic frames 1 and 2, each of which consists of a respective one of the rear legs 10 and 12 of the chair and the diagonally opposite front legs 14, 16 of the chair. Extending between legs 10 and 14 are upper and lower cross members 18 and 20, each of which has the opposite ends fixed to the respective legs of the pertaining frame.

Figure 1A:
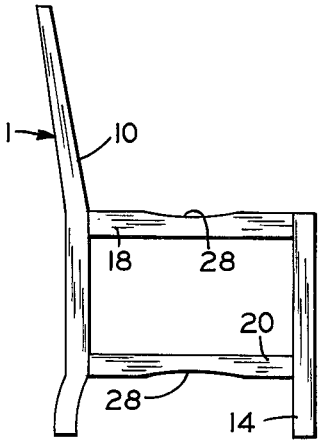
FIGS. 1A and 1B show elevational views of the two basic frame members making up the chair structure.
Figure 1B:
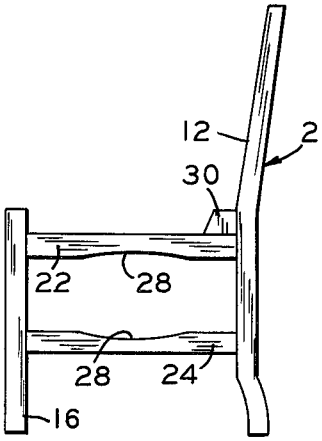

Similarly, cross members 22 and 24 are provided which extend between and are fixed to legs 12 and 16. As will be seen in FIGS. 1A and 1B, cross members 18 and 22 form a pair which will overlap when the chair is assembled and cross members 20 and 24 also form a pair which will overlap when the chair is assembled. The cross members 22 and 24 will fit between cross members 18 and 20 and at the points of overlap or intersection of each pair of cross members there is provided a vertical pivot bolt 26 as will best be seen in FIG. 4.

The cross members may include recessed regions 28 where the cross members overlap so that any pivot bolt has the upper end disposed well below the seat member of the chair. By providing the recess 28 in all of the cross members, the cross members can be made identical and thereby effect a saving.

When the frames 10 and 12 are assembled, the one cross member 18 will have the upper surface flush with the upper end of the respective front leg 14 and will thus provide a supporting surface for the seat member of the chair.

The frame 12, on the other hand, has cross member 22 disposed below the seat so that the upper end of the respective front leg 16 and the upper surface of an added bracket 30 will provide support for the seat of the chair.

Figure 3:
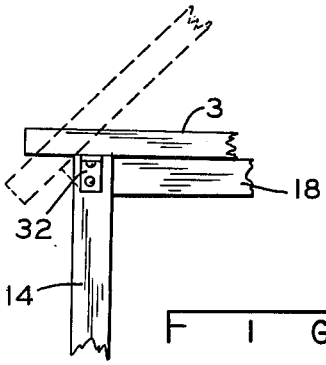
FIG. 3 shows a swivel connection between the seat member of the chair and one of the chair legs.
Figure 5:
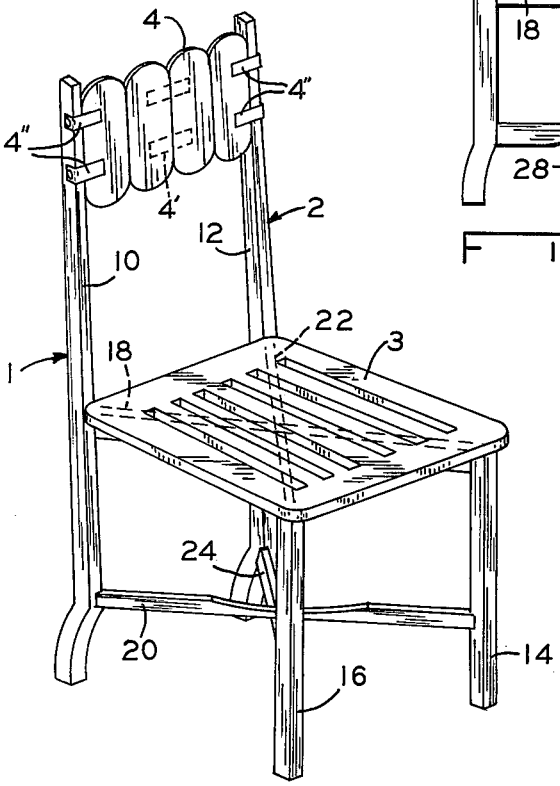
FIG. 5 is a perspective view showing the chair in erected position.

The seat member referred to is indicated by reference numeral 3 in FIGS. 2, 3 and 5 and will be seen to include a swivel connection 32 between the seat and one of the front legs of the chair, for example, leg 14.

Figure 4:
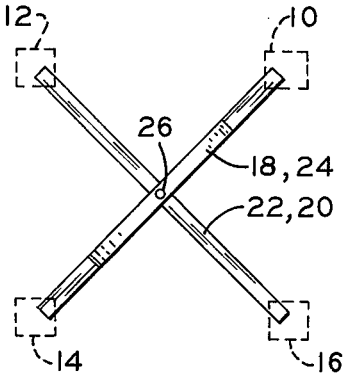
FIG. 4 is a fragmentary plan view showing the pivotal interconnection between the cross members of each of the upper and lower pairs thereof.

It will be noted that the rear legs 10 and 12 extend upwardly from the level of seat 3 and near their upper ends are interconnected by a flexible back 4 which is made up of plate elements interconnected as by pivot means 4' so that the back can collapse from the position in which it is shown in FIG. 5 into the position in which it is shown in FIG. 4. To this end, pivot means 4" are also provided between the ends of back 4 and the upper ends of rear legs 10 and 12 of the chair.

In practice, the two frames 1 and 2 can be manufactured and then assembled and pivot bolts 26 put in place. Thereafter, back 4 and seat 3 can be connected to the chair frame by the respective pivots and swivel. When the frames 1 and 2 are spread apart as shown in FIG. 5, the back 4 flattens out and the seat member 3 can be placed in a horizontal position and the chair is then ready for use.

To collapse the chair, seat 3 is swivelled about its swivel connection 32 to the FIG. 2 position thereof while the back 4 is buckled, preferably in the forward direction, and the two frames 1 and 2 are moved together by relative pivotal movement about the pivot bolts 26 between the two upper and lower sets of cross members. The chair, when collapsed, can readily be stored in a small space.

It will be appreciated that no pivot joint in the chair is subjected to extreme abuse when the chair is in use so that the chair has long life while, at the same time, presenting a rather conventional appearance and possessing substantially the same rigidity as a conventional chair.

Modifications may be made within the scope of the appended claims.

What is claimed is:

1. In a foldable chair; a generally rectangular, one-piece seat member, a pair of front legs having upper ends, a pair of rear legs, upper and lower pairs of overlapped cross members with each cross member connected at one end to a rear leg and at the other end of the front leg diagonally opposed to the respective rear leg, pivot means pivotally connecting the cross members of each pair at the region of overlap thereof, means including the top cross member of the upper pair of cross members for supporting said seat member in a substantially horizontal position with two front corners respectively in general alignment with said front leg upper ends when the chair is erected, and a single swivel connecting one of said front corners of the seat member to the respective front leg upper end whereby said seat member is adapted to be moved to a vertical position when the chair is folded.

2. A foldable chair according to claim 1 in which the cross members extending from one of the rear legs to the diagonally opposed front leg comprise the upper cross member of one of the pairs of cross members and the lower cross member of the other pair of cross members.

3. A foldable chair according to claim 2 in which each rear leg and the diagonally opposed front leg and the cross members connected thereto form a subframe of the chair adapted for independent manufacture and for assembly with a mating subframe to form the chair frame.

4. A foldable chair according to claim 1 in which the top cross member of the upper pair thereof forms a support for the seat member.

5. A foldable chair according to claim 1 in which the upper ends of the front legs and the top surface of the top cross member of the upper pair thereof support the seat member when the chair is erected, and a support member on top of the bottom cross member of the upper pair adjacent the respective rear leg to provide further support for the respective corner of the seat member.

6. A foldable chair according to claim 1 wherein said rear legs include upper portions extending upwardly from said seat member when the chair is erected, and which includes a laterally collapsible back support connected to the upper portions of the rear legs and extending laterally therebetween when the chair is erected.

7. A foldable chair according to claim 6 in which said back support comprises panels having adjacent vertical edges hingedly interconnected and other vertical edges hingedly connected to said upper portions of the rear legs of the chair.

* * * * *